US008147388B2

(12) United States Patent
Bingham et al.

(10) Patent No.: US 8,147,388 B2
(45) Date of Patent: Apr. 3, 2012

(54) BIKE TRAINER

(75) Inventors: Robert J. Bingham, Everett, WA (US); Ryan P. Selby, Woodinville, WA (US); Neil P. Everson, Woodinville, WA (US)

(73) Assignee: Lemond Fitness, Inc., Woodinville, WA (US)

( * ) Notice: Subject to any disclaimer, the term of this patent is extended or adjusted under 35 U.S.C. 154(b) by 84 days.

(21) Appl. No.: 12/785,394

(22) Filed: May 21, 2010

(65) Prior Publication Data

US 2011/0287902 A1 Nov. 24, 2011

(51) Int. Cl.
*A63B 22/06* (2006.01)

(52) U.S. Cl. ..... 482/57; 482/61

(58) Field of Classification Search ..... 482/57, 482/58, 61, 63, 111, 113; 248/121
See application file for complete search history.

(56) References Cited

U.S. PATENT DOCUMENTS

| | | | | |
|---|---|---|---|---|
| 3,240,153 | A * | 3/1966 | Schrader | 416/180 |
| 4,789,153 | A * | 12/1988 | Brown | 482/111 |
| 4,981,294 | A * | 1/1991 | Dalebout et al. | 482/59 |
| RE34,959 | E | 5/1995 | Potts | |
| 5,480,366 | A * | 1/1996 | Harnden et al. | 482/61 |
| 5,944,637 | A | 8/1999 | Stickler et al. | |
| 6,612,597 | B2 * | 9/2003 | Baker et al. | 280/204 |
| 6,945,917 | B1 * | 9/2005 | Baatz | 482/63 |
| 7,226,395 | B2 * | 6/2007 | Wu et al. | 482/57 |
| 7,351,171 | B2 * | 4/2008 | Kanehisa et al. | 474/160 |
| 2004/0130117 | A1 * | 7/2004 | Lipton | 280/204 |
| 2005/0227822 | A1 * | 10/2005 | Liou | 482/57 |
| 2007/0222278 | A1 * | 9/2007 | Hoisington | 301/58 |

OTHER PUBLICATIONS

Photograph of a bike trainer sold more than one year prior to the filing date.

* cited by examiner

*Primary Examiner* — Loan Thanh
*Assistant Examiner* — Tam Nguyen
(74) *Attorney, Agent, or Firm* — Davis Wright Tremaine LLP; George C. Rondeau, Jr.

(57) ABSTRACT

A bike trainer operable by a user for stationary riding when a conventional bicycle is coupled thereto. The bike trainer may be used by removing the rear wheel of the bicycle and selectively coupling the rear dropouts of the bicycle to an axle of the bike trainer. The bike trainer is operative to simulate the "feel" of riding a moving bicycle by providing resistance and inertia similar to that of a bicycle when used normally. To provide these features, the bike trainer includes a fan/flywheel as well as a freewheel mechanism. The bike trainer also includes features that permit simple coupling and decoupling to the bicycle using a "quick release skewer," which allows users to easily use the bike trainer without required a substantial amount of time. The bike trainer also includes a base configured to support a user of the bike trainer in a fashion such that the user is sturdily supported during use.

24 Claims, 9 Drawing Sheets

BIKE TRAINER

BACKGROUND OF THE INVENTION

1. Field of the Invention

The present invention is directed generally to exercise devices, and more particularly to devices that provide resistance and are configured for use as bike trainers.

2. Description of the Related Art

Bike trainers (or "bicycle trainers") have been used by bicycling enthusiasts to support their bicycles for stationary riding. Rather than ride in cold, hot, or rainy weather, a cyclist may use the trainer to ride indoors and obtain an aerobic, cardiovascular workout. Bike trainers also obviate the need for purchasing a separate stationary bicycle for persons who want to occasionally workout while, for example, reading or watching television.

A typical bike trainer has a frame onto which a user mounts a bicycle. The rear wheel of the bicycle contacts a roller or like mechanism connected to a resistance unit. Resistance to the rotation of the rear wheel may be adjustable. In addition, it would be desirable for a resistance unit to provide increased resistance as the rotation of the wheel is increased, so that more energy is required to pedal the bicycle and the rider receives a greater workout.

BRIEF DESCRIPTION OF THE SEVERAL VIEWS OF THE DRAWING(S)

DETAILED DESCRIPTION OF THE INVENTION

Figure 1:
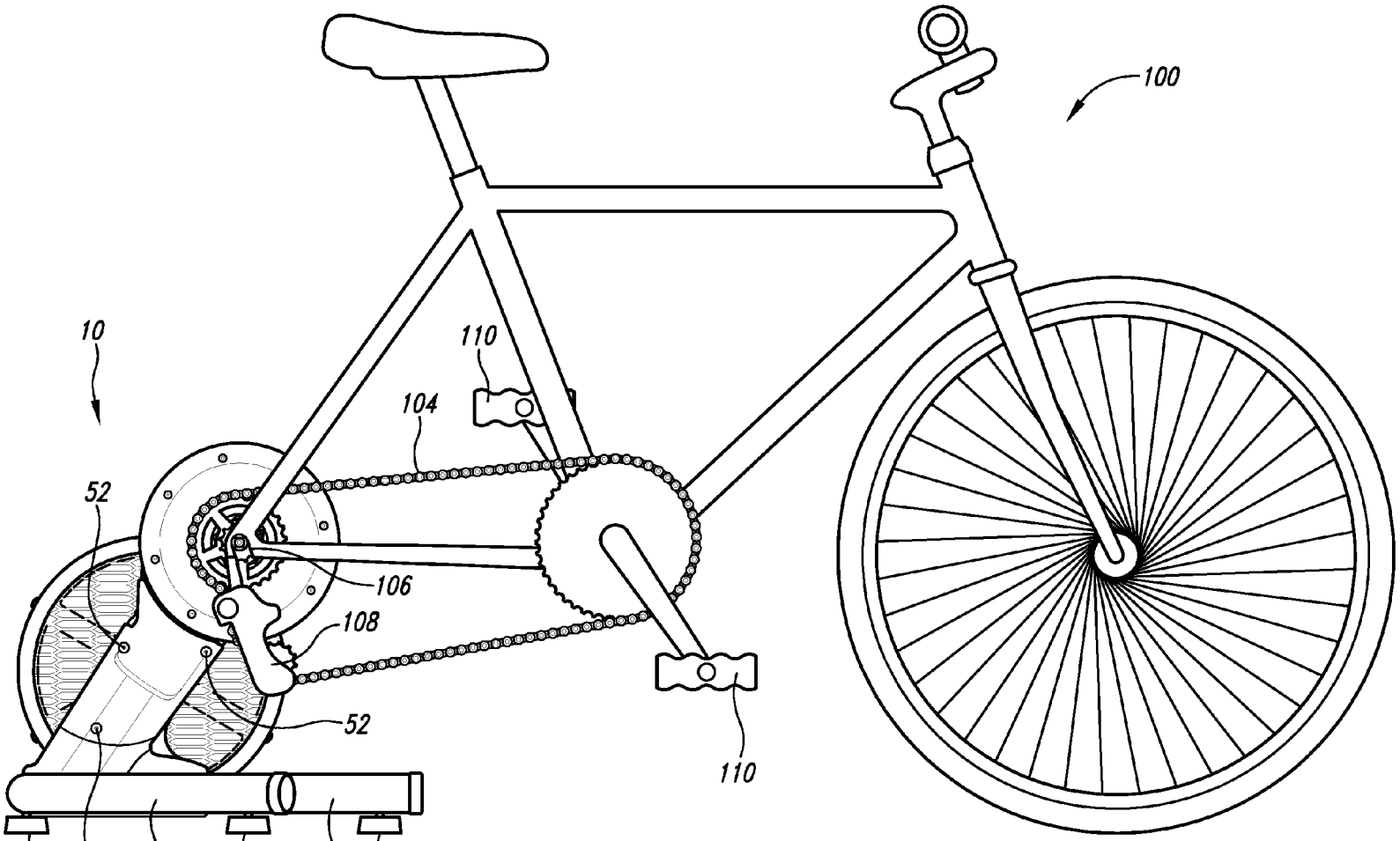
FIG. 1 is a right side view of a bike trainer attached to a conventional bicycle.

FIGS. 1-9 illustrate various views of a bike trainer 10 that may be operated by a user for stationary riding when coupled to a conventional bicycle 100 (shown in FIG. 1). Advantageously, the bike trainer 10 includes features described below that simulate the "feel" of riding a moving bicycle by providing resistance and inertia similar to that of a bicycle when used normally. The bike trainer 10 also includes features that permit simple coupling and decoupling to the bicycle 100, which allows users to easily use the bike trainer 10 without requiring a time consuming setup process. As an example, users may wish to use the bike trainer 10 when weather conditions are not conducive to riding outdoors, or when locations to ride a bicycle are otherwise undesirable or unavailable. Further, the bike trainer 10 is configured to support a user of the bike trainer in a fashion such that the user is sturdily supported without having to worry about losing his or her balance.

Figure 8:
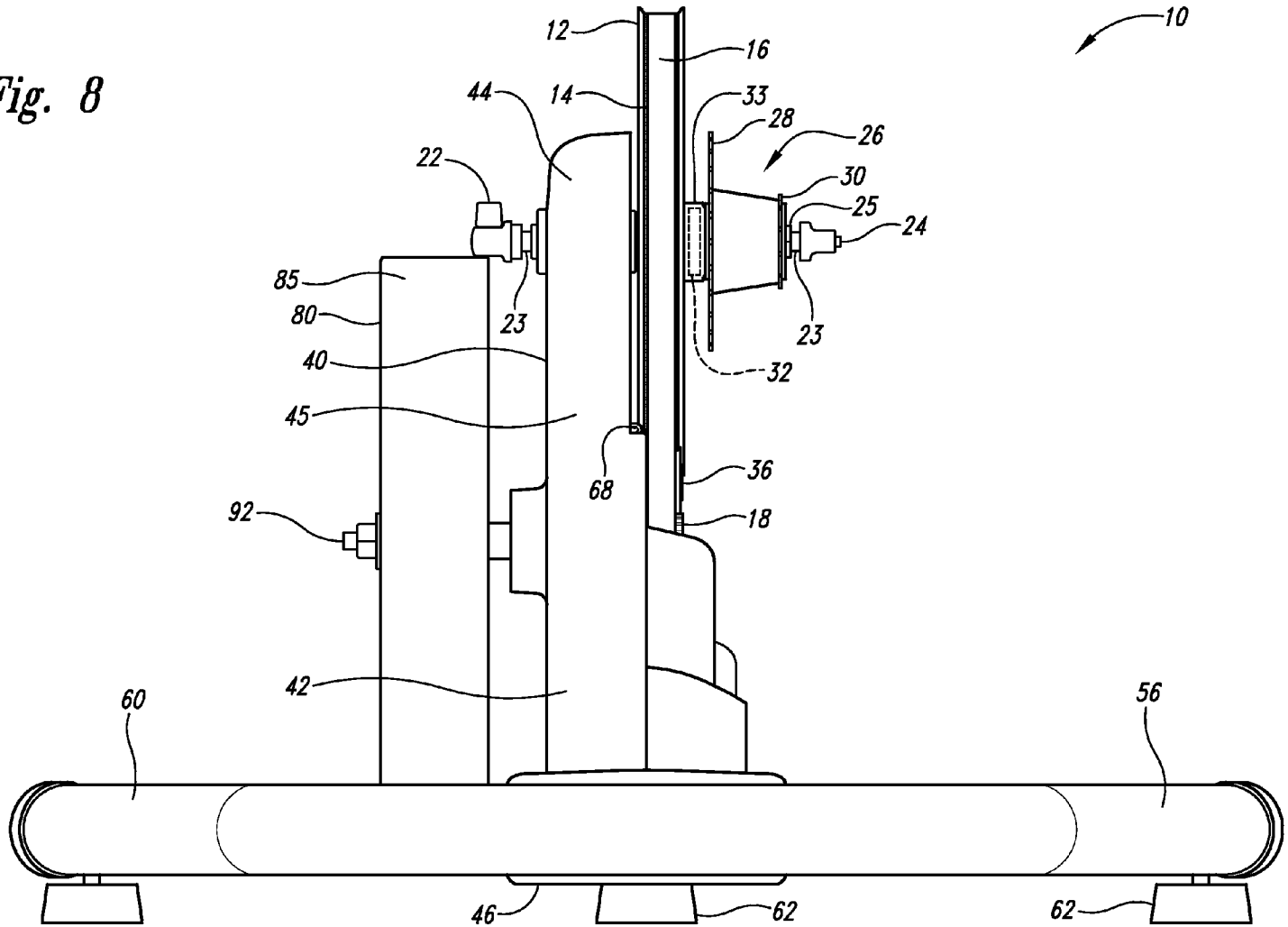
FIG. 8 is a rear view of the bike trainer with the fan housing and covers removed.
Figure 9:
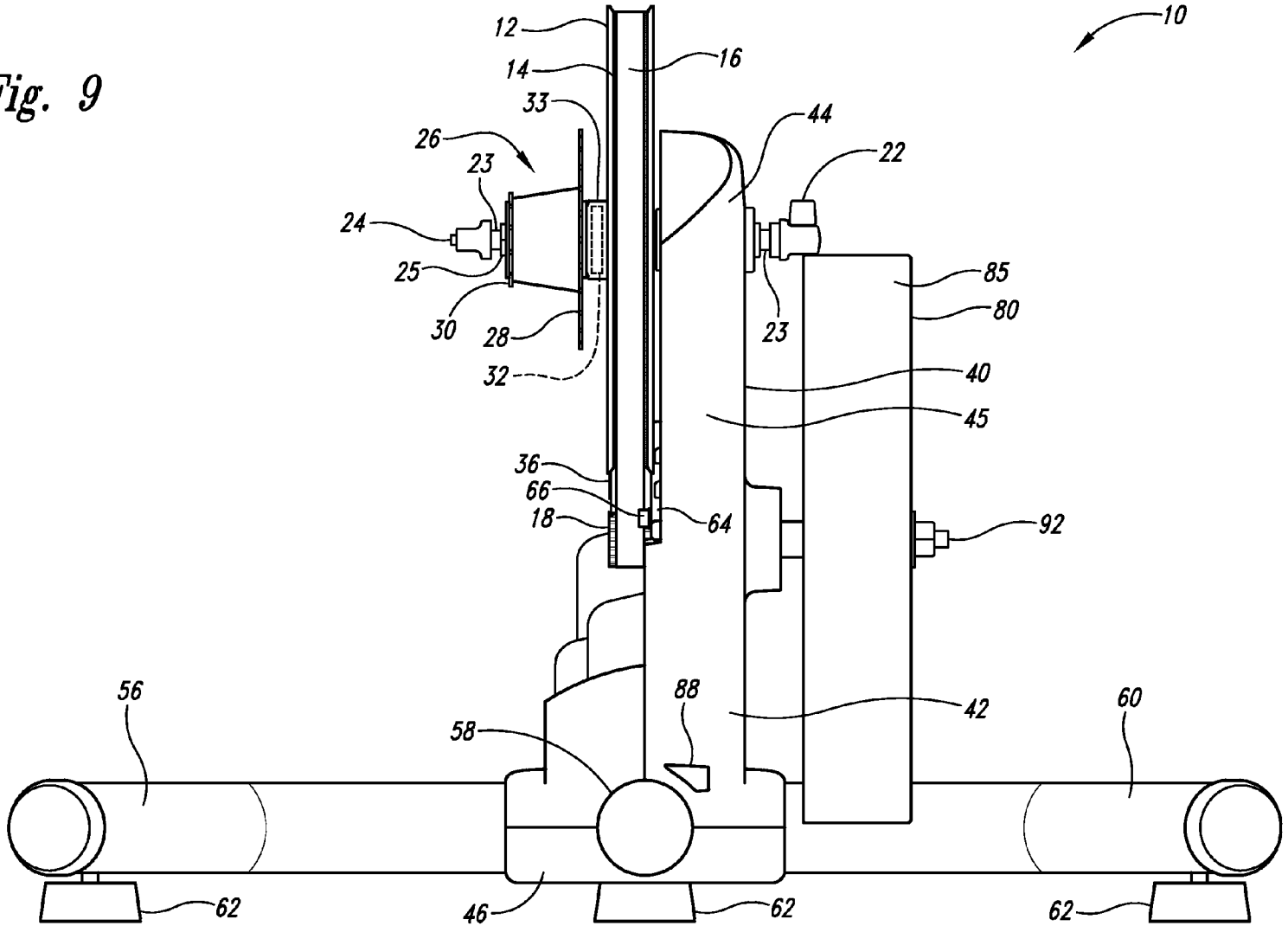
FIG. 9 is a front view of the bike trainer with the fan housing and covers removed.

FIG. 1 is a right side view of the bike trainer 10 when coupled to the bicycle 100. The bike trainer 10 includes a first pulley 12 (or drive member) that is rotatably coupled to a laterally extending axle 23 (see FIG. 8) proximate to an upper portion 44 of a frame 40. When the bike trainer 10 is coupled to the bicycle 100, the first pulley 12 takes the place of the rear wheel of the bicycle. In this regard, the rear dropouts 106 of the bicycle 100 are removably coupled to the axle 23 which is secured by an axle clamp 24 and an axle clamp adjustment 22 (see FIGS. 2 and 3), which may collectively be referred to as a "quick release skewer." The first pulley 12 is coupled to a pulley hub 32 which is best shown in FIGS. 8 and 9. A cassette 26 is positioned over the pulley hub 32 and includes a freewheel mechanism or "freehub" housed therein. The cassette 26 also includes a first sprocket 28 and a second sprocket 30, although it will be appreciated that the cassette 26 may include several sprockets (e.g., 1 to 12 sprockets, or more) of varying sizes having a varying number of teeth. The cassette 26, pulley hub 32, and first pulley 12 are removably and rotatably secured to an upper portion 44 of the frame 40 using a hexagonal nut 25 (see FIG. 2).

To use the bike trainer 10, a user first removes the rear wheel of the bicycle 100, secures the rear dropouts 106 of the bicycle to the bike trainer 10, tightens the axle clamp adjustment 22, and aligns a chain 104 of the bicycle with one of the sprockets of the cassette 26. In operation, the cassette 26 works with a rear derailleur 108 of the bicycle 100 to provide multiple gear ratios for a user of the bike trainer 10. As can be appreciated the freehub 32 includes a conventional freewheel mechanism that allows a user of the bike trainer 10 to stop pedaling whilst the first pulley 12 is still in motion, which simulates the feel of "coasting" on a moving bicycle. That is, the freewheel mechanism includes a first portion engaged with the first pulley 12 and a second portion engaged with the cassette 26, such that the freewheel mechanism is operative to disengage the first portion from the second portion when the first portion rotates faster than the second portion as would be the situation if the bicycle 100 was moving in a forward direction.

In some embodiments, an adapter 33 (see FIGS. 8 and 9) may be provided to allow various custom or "off the shelf" cassettes to be coupled to the pulley hub 32 and over the freewheel mechanism so that they may be used with the bike trainer 10. Manufacturers of cassettes that may be used with the bike trainer 10 include but are not limited to Shimano, Campagnolo, SRAM, and the like. Further, some embodiments may include "spacers" positionable on the axle 23 and secured by the axle clamp 24 and the axle clamp adjustment 22 to accommodate bicycles having differing spacing between their rear dropouts, such as road bicycles and mountain bicycles. As can be appreciated, the spacers may be also rest freely on the axle 23, may be threaded onto the axle 23, or may otherwise be positioned thereon.

Figure 2:
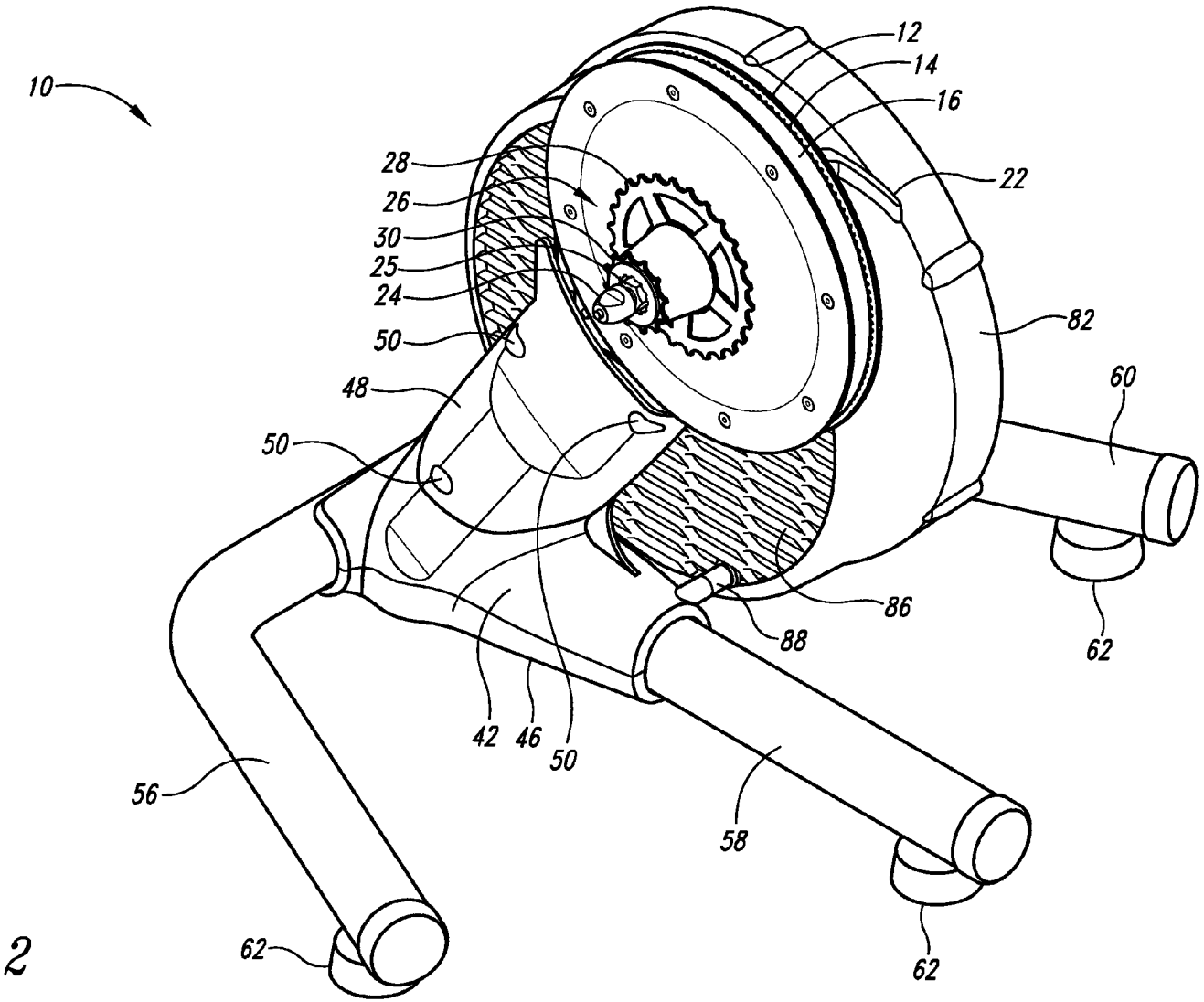
FIG. 2 is a right-front perspective view of the bike trainer with the fan housing and covers installed.
Figure 4:
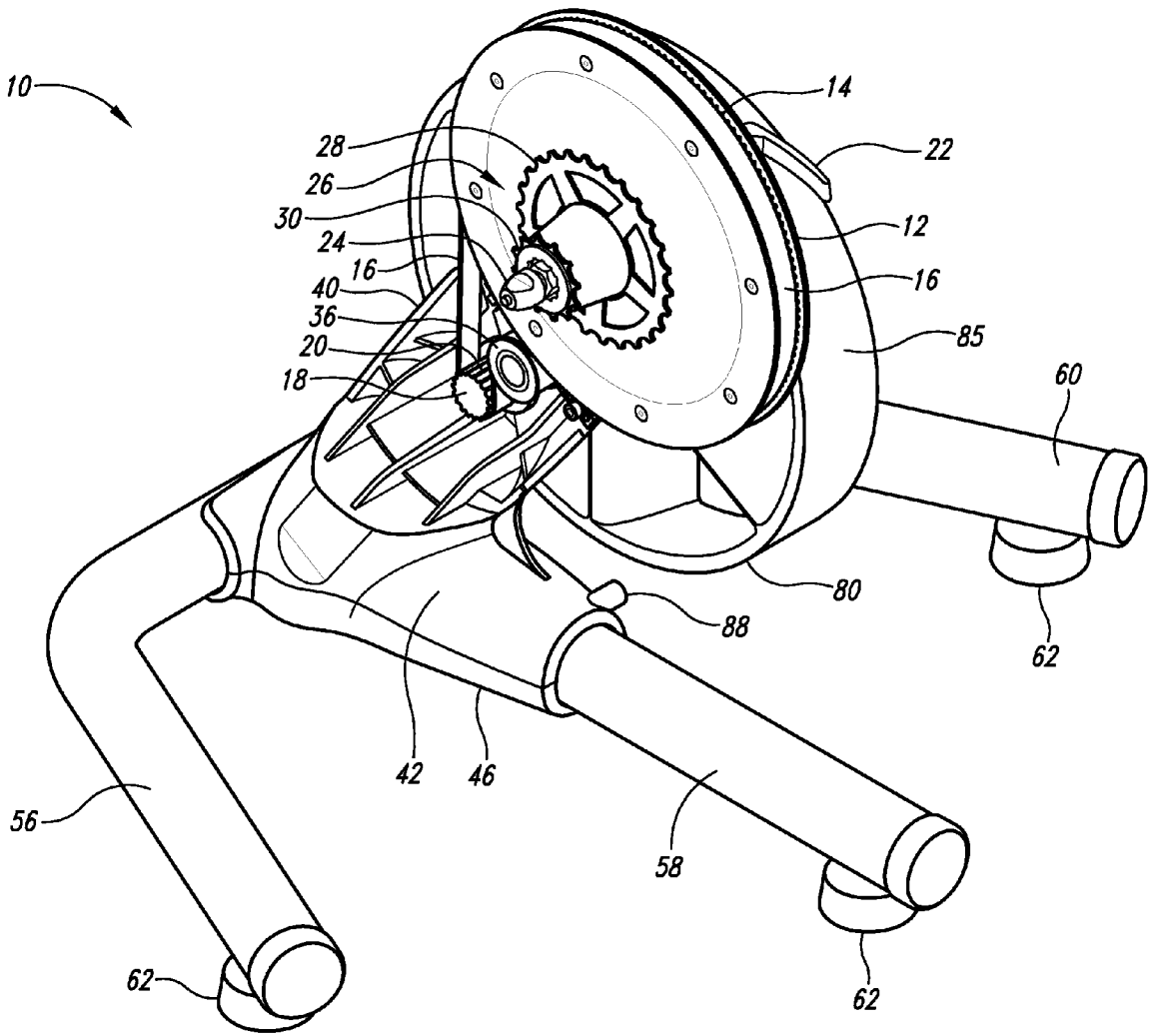
FIG. 4 is a right-front perspective view of the bike trainer with the fan housing and covers removed.
Figure 5:
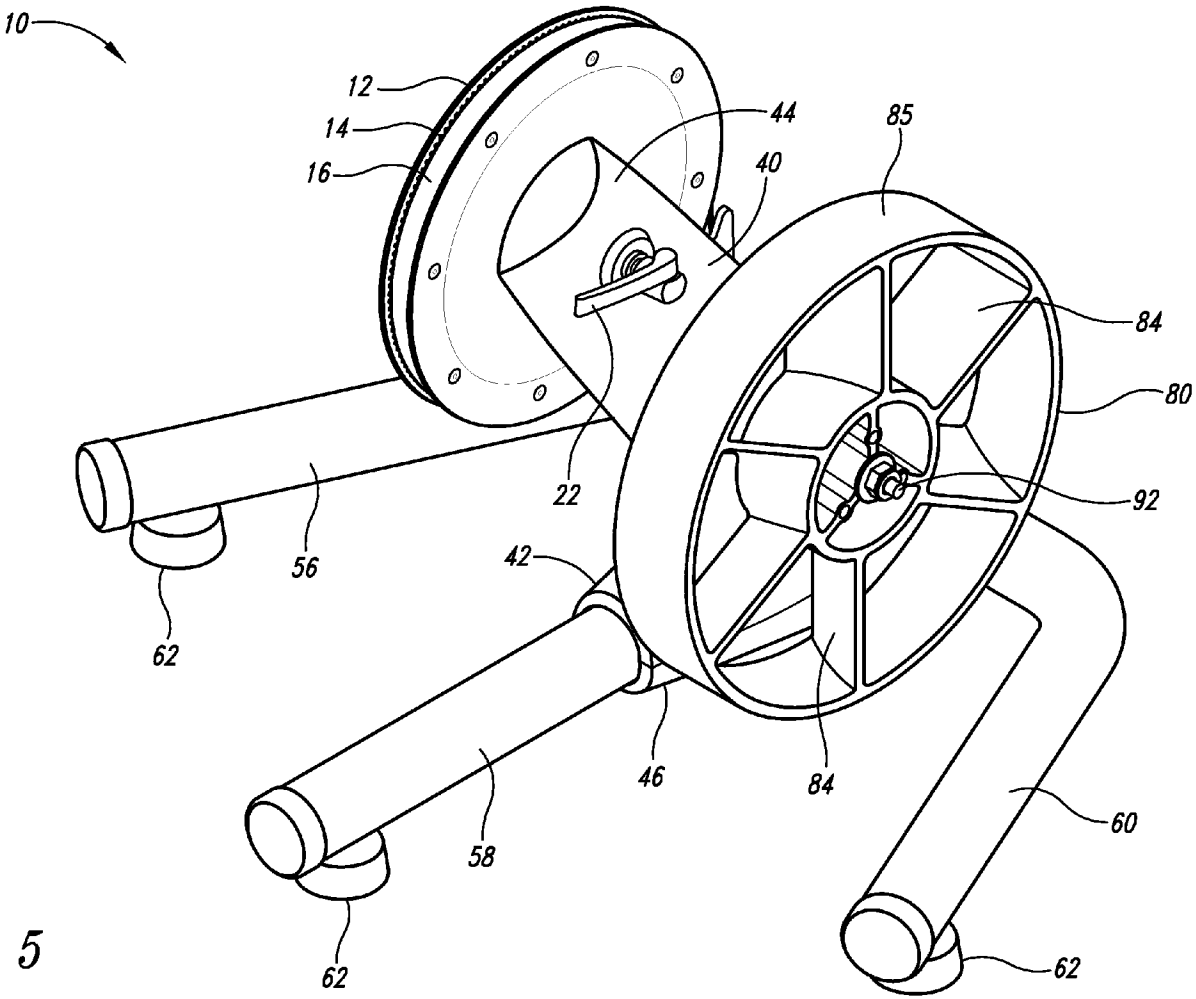
FIG. 5 is a left-front perspective view of the bike trainer with the fan housing and covers removed.

As may best be viewed in FIGS. 2 and 4, the first pulley 12 includes teeth 14 configured to interface with a flexible drive member or belt 16 to provide transmission of power. As shown, the belt 16 is wrapped around a portion of the outer circumference of the first pulley 12 and around a smaller second pulley 18 rotatably coupled to a laterally extending axle 92 (see FIG. 5) positioned at a mid-portion 45 of the frame 40. The ratio of the diameter of the first pulley 12 to the diameter of the second pulley 18 may be between about 4 to 1 and 12 to 1 (e.g., 8 to 1), but it is not so limited. Similar to the first pulley 12, the second pulley 18 includes teeth 20 configured to interface with the belt 16. A fan 80 is coupled to the axle 92, and may be press fit or otherwise secured to the axle 92 on a side of the frame 40 opposite the side of the second pulley 18 and where the bicycle 100 is positioned. In operation, when a user rotates the pedals 110 of the bicycle 100, the belt 16 causes the first pulley 18 to drive the second pulley 18, thereby rotating the fan 80.

Figure 6:
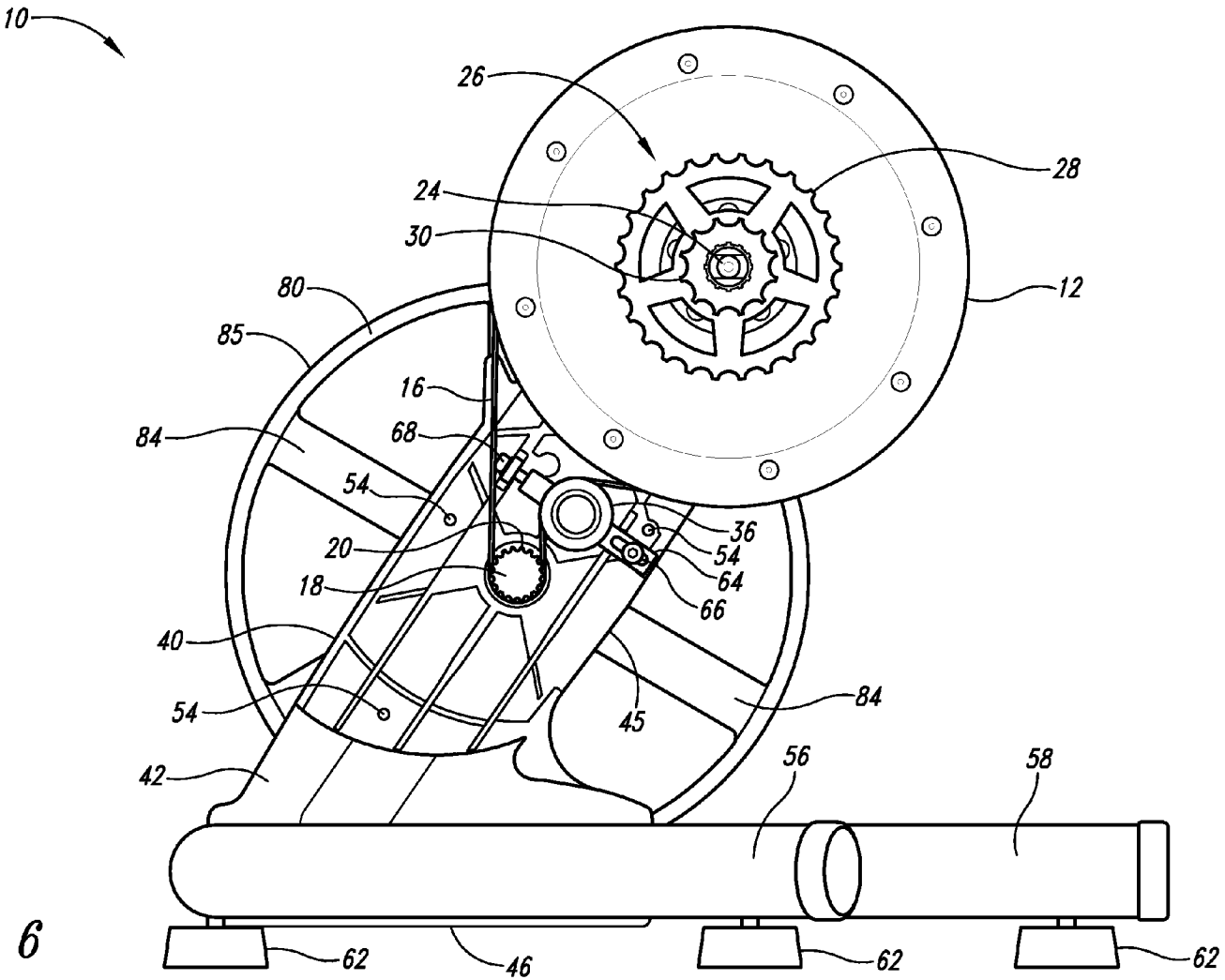
FIG. 6 is a right side view of the bike trainer with the fan housing and covers removed.
Figure 7:
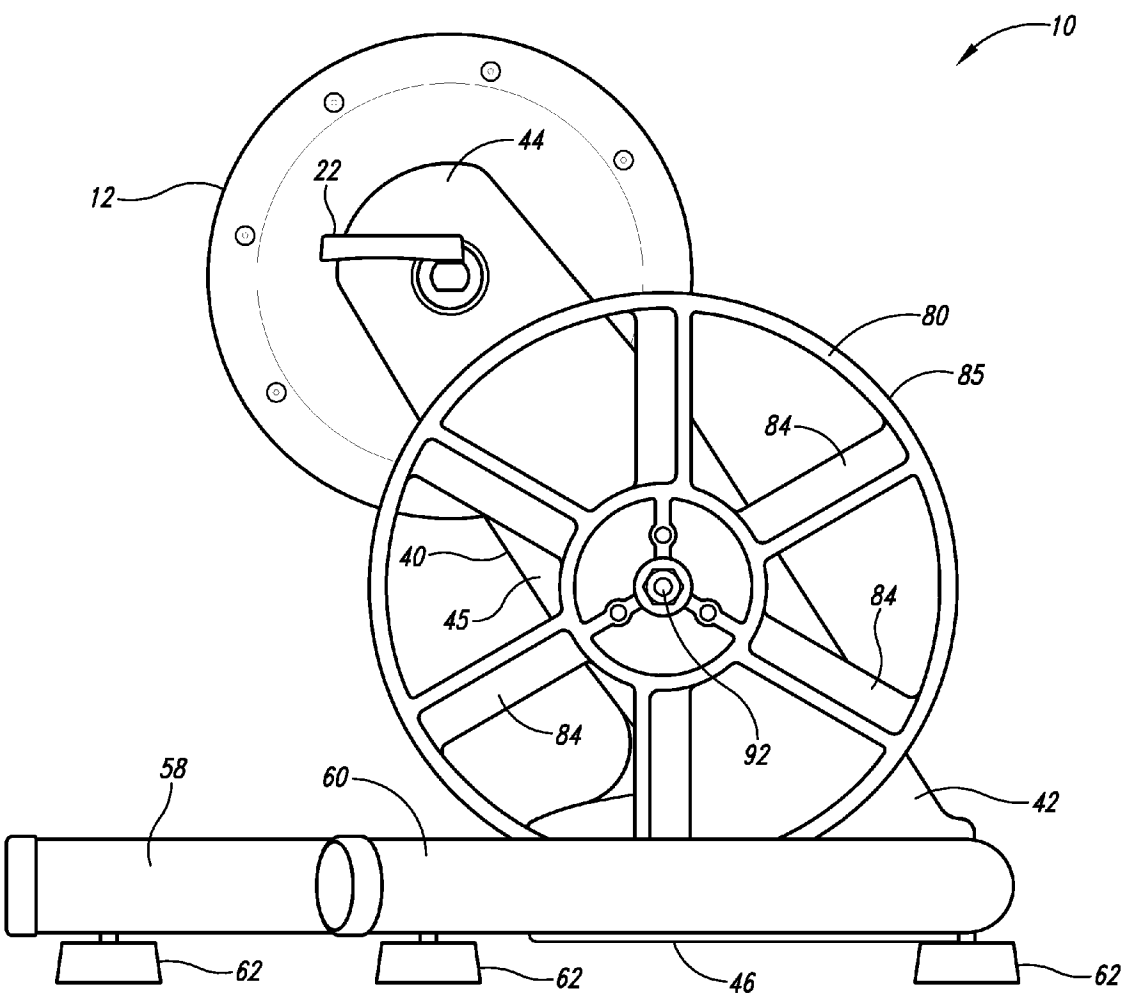
FIG. 7 is a left side view of the bike trainer with the fan housing and covers removed.

As best viewed in FIGS. 4 and 6, an idler/tension pulley 36 is provided to allow a user to selectively adjust the tension of the belt 16. Further, as can be appreciated, in the event where the belt 16 is to be removed, a user may simply adjust the position of the tension pulley 36 to a position wherein the belt 16 is loose enough to be removed from the pulleys 12, 18, and 36. As shown in FIG. 6, the tension pulley 36 is coupled to a tension pulley adjustment 64 that comprises a tension adjusting bolt 68 and an adjustment lock bolt 66. In operation, a user may loosen or tighten the tension adjusting bolt 68 until the tension pulley 36 is in a desired position (and the belt 16 is at a desired tension) and then tighten the adjustment lock bolt 66 to secure the positioning of the tension pulley 36. This configuration permits a user to easily adjust the tension of the belt 16 or to remove the belt while securely maintaining the tension of the belt during use over a period of time. As can be appreciated, the belt 16 may be removed from the pulleys without requiring removal of the bicycle 100 from bike trainer 10, and without removing substantial components (e.g., the fan 80) of the bike trainer.

The bike trainer 10 may be supported by a center support member 58, a laterally extending right support member 56 and a laterally extending left support member 60, which are removably coupled to the frame 40. In the embodiment shown, the left support member 60 and the right support member 56 are integrally formed, but this is not a requirement. The support members 56, 58, and 60 also include a total of four pads 62 to provide a stable interface between the bike trainer 10 and a supporting surface (e.g., a floor). One of the pads 62 is positioned near each forward end of each of the support members 56, 58, and 60, and one pad is positioned near the rearward intersection of the left support member 60 and the right support member 56. The height of each of the pads 62 relative to the support members 56, 58, and 60 may be adjustable so that the bike trainer 10 may be sturdily supported by an uneven surface without rocking. As can be appreciated, this configuration provides substantial support to the bike trainer 10 and bicycle 100 when a user is operating the bike trainer 10, such that the user remains stable on the bicycle 100 without rocking during use. It should also be appreciated that the number of pads 62 may be varied as well (e.g., three pads, six pads, or the like).

The support members 56, 58, and 60 are coupled to a lower portion 42 of the frame 40 using one or more fasteners such as screws (not shown). As illustrated, when coupled together, the lower portion 42 of the frame 40 and a lower shell 46 form a hollow interior region sized to receive rearward portions of the support members 56, 58, and 60. One or more fasteners, such as screws, may be used to secure the support members 56, 58, and 60 to the lower shell 46 and to the lower portion 42 of the frame 40. Advantageously, by permitting the support member 56, 58, and 60 to be selectively removed from the remainder of the bike trainer 10, the bike trainer 10 may be relocated and/or shipped more efficiently.

In operation, the fan 80 acts as a flywheel to provide resistance as well as inertia to the bike trainer 10. As the fan 80 rotates at a higher speed, the air resistance provided by a plurality of radially extending fan blades 84 provides relatively more resistance to a user of the bike trainer 10. Further, the fan 80 has a suitable weight such that it has a relatively high moment of inertia, thereby storing a large amount of rotational energy. To further increase the inertia provided by the fan 80 as it rotates, a significant portion of the weight of the fan is disposed at its periphery. This is achieved by an outer band 85 that extends circumferentially around the distal ends of each of the fan blades 84. This inertia provided by the fan 80 allows the bike trainer 10 to provide a feel of "coasting" for a user, such that the energy produced by pedaling is not immediately lost after the user stops pedaling. As can be appreciated, this feature of the present disclosure provides a user with a riding experience that is similar to a moving bicycle.

To provide a suitable amount of inertia, the fan 80 may be formed from ductile iron, steel, or any other material or materials having a relatively high toughness and density. Additionally, the fan 80 may have a weight of about 5 to 25 pounds (e.g., 15 pounds). The moment of inertia of the fan 80 about its spinning axis may be about 220 to 260 pound square inches (lb*in^2). Further, as shown best in FIGS. 5 and 7, the fan blades 84 are oriented such that during use air will flow from right to left, that is, from the side of the fan 80 near the frame 40 to the side of the fan spaced apart from the frame 40. Additionally, the shape and positioning of the blades 84 provide suitable resistance without generating a substantial amount of noise, such that the bike trainer 10 is relatively quiet during operation. Another quality resulting from the orientation of the fan blades 84 is that during use the fan 80 is driven toward the frame 40, such that if for some reason the fan 80 came loose, it would be driven toward the frame 40 and not toward the free end. As can be appreciated, this feature may possibly prevent the fan 80 from falling off the axle 92 and coming into contact with objects or persons.

As best shown in FIGS. 1 and 2, the bike trainer 10 may also include a selectively removable cover 48 that is fastened to the mid portion 45 of the frame 40. The cover 48 is operative to cover the second pulley 18, the tension pulley 36, and the tension pulley adjustment 64. The cover 48 includes cover fastener recesses 50 that are aligned with threaded cover fastener apertures 54 (see FIG. 6) in the frame 40. Cover fasteners 52 (e.g., screws) may be used to removably secure the cover 48 to the frame 40.

Figure 3:
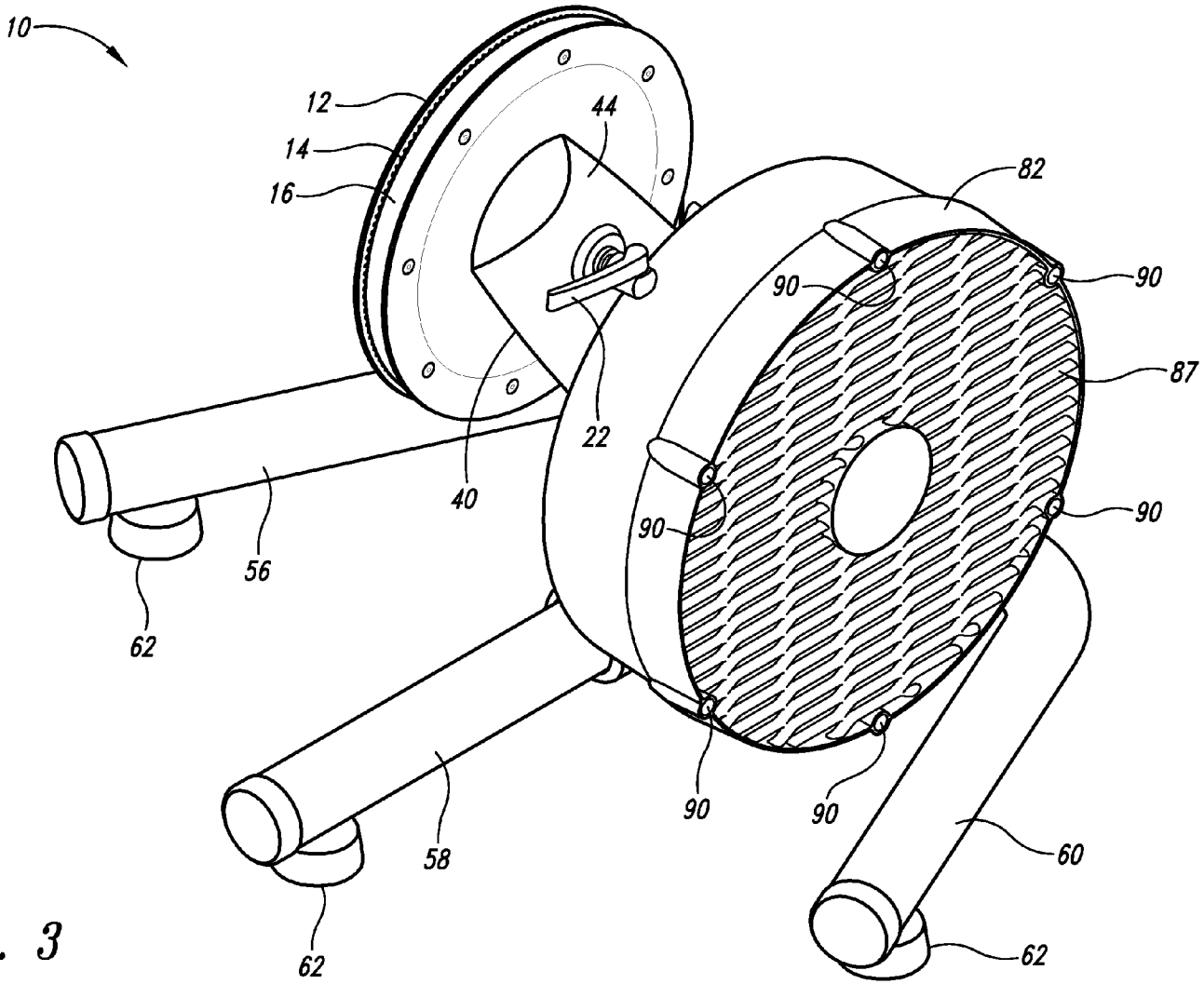
FIG. 3 is a left-front perspective view of the bike trainer with the fan housing and covers installed.

Additionally, a fan housing 82 may be provided to enclose the fan 80. The fan housing includes a right fan grill 86 and a left fan grill 87. As shown in FIG. 3, the left fan grill 87 may be removably secured to the fan housing 82 by fasteners 90 (e.g., screws). Further, the fan housing 82 may be selectively secured to the lower portion 42 of the frame 40 by a fan housing fastener 88. The fan housing 82 may be formed from any suitable materials (e.g., plastic). As can be appreciated, the fan housing 82 may generally reduce the likelihood of objects coming into contact with the fan 80.

The bike trainer 10 shown and described herein permits a user to simulate the feel and ride of his or her own bicycle, thereby providing a quality workout when riding a bicycle in a conventional manner is undesirable (e.g., poor weather, limited space, or the like). As discussed above, the bike trainer 10 provides a these features by creating a suitable amount of resistance to allow users to get an effective workout, and by providing a freewheel and flywheel mechanism to preserve the rotational energy generated by a user by pedaling a bicycle coupled to the bike trainer 10. Further, by providing a substantial support structure, a user of the bike trainer 10 is sturdily supported on his or her bicycle during use.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention.

Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A bike trainer for use as a training device when coupled to a conventional bicycle having its rear wheel removed, the bicycle including a frame that includes rear dropouts, the bike trainer comprising:

a frame;

a first drive member rotatably mounted on a first side of the frame on a laterally extending first axle, the first axle being configured for selective coupling with the rear dropouts of the bicycle;

a freewheel mechanism including a first portion engaged with the first drive member, and a second portion engaged with a cassette having a plurality of sprockets each configured to interface with a chain of the bicycle when the bicycle is coupled to the bike trainer, the freewheel mechanism further including an adapter configured to permit the second portion to engage more than one type of cassette, wherein the freewheel mechanism is operative to disengage the first portion from the second portion when the first portion rotates faster than the second portion in a forward direction;

a second drive member rotatably mounted on the first side of the frame on a laterally extending second axle;

a flexible drive member in driving engagement with and extending between the first drive member and the second drive member; and a fan rotatably mounted on the second axle on a second side of the frame opposite the first side.

2. The bike trainer of claim 1, further comprising:

a base coupled to a lower portion of the frame and operative to support the frame during use, the base comprising a center support portion, a laterally extending left support portion, and a laterally extending right support portion.

3. The bike trainer of claim 1, wherein the first axle is secured to the frame by an axle clamp and an axle clamp adjustment, such that a user may selectively couple the rear dropouts of the bicycle to the bike trainer without the use of tools.

4. The bike trainer of claim 1, wherein the first drive member and the second drive member each include teeth.

5. The bike trainer of claim 1, further comprising:

a tension pulley rotatably mounted on the frame at a position between the first drive member and the second drive member, and a tension pulley adjustment coupled to the frame and operative permit a user to selectively adjust the position of the tension pulley to selectively adjust the tension of the flexible drive member.

6. The bike trainer of claim 1, further comprising:

a fan housing enclosing the fan and including a first fan grill and a second fan grill positioned on opposing sides of the fan housing.

7. The bike trainer of claim 1, wherein the fan comprises:

a plurality of radially extending fan blades each having a proximal end and a distal end; and an outer band that extends circumferentially around distal ends of each of the plurality of fan blades.

8. The bike trainer of claim 7, wherein the plurality of fan blades are angled such that when the fan rotates in a forward direction, air will flow from a side of the fan proximate to the frame to a side of the fan spaced apart from the frame.

9. The bike trainer of claim 1, wherein the fan is formed from ductile iron material.

10. The bike trainer of claim 1, wherein the fan has a weight that is between 10 pounds and 15 pounds.

11. The bike trainer of claim 1, wherein the fan has a moment of inertia about its spinning axis of between 220 and 260 pound square inches ($lb*in^2$).

12. A method of training using a bike trainer, comprising providing a bicycle having its rear wheel removed, the bicycle including a frame that includes rear dropouts;

providing a bike trainer comprising:

a frame;

a first drive member rotatably mounted on a first side of the frame on an laterally extending first axle, the first axle being configured for selective coupling with the rear dropouts of the bicycle;

a freewheel mechanism including a first portion engaged with the first drive member, and a second portion engaged with a cassette having a plurality of sprockets each configured to interface with a chain of the bicycle when the bicycle is coupled to the bike trainer, the freewheel mechanism further including an adapter configured to permit the second portion to engage more than one type of cassette, wherein the freewheel mechanism is operative to disengage the first portion from the second portion when the first portion rotates faster than the second portion in a forward direction;

a second drive member rotatably mounted on the first side of the frame on a laterally extending second axle;

a flexible drive member in driving engagement with and extending between the first drive member and the second drive member; and a fan rotatably mounted on the second axle on a second side of the frame opposite the first side;

coupling the rear dropouts of the bicycle to the first axle of the bike trainer;

positioning a chain of the bicycle in contact with one of the sprocket sprockets of the cassette; and rotating pedals of the bicycle to cause the chain to impart a drive force on the sprocket.

13. A bike trainer for use as a training device when coupled to a conventional bicycle having its rear wheel removed, the bicycle including a frame that includes rear dropouts, the bike trainer comprising:

a frame;

a first pulley rotatably mounted on a first side of the frame on a laterally extending first axle, the first axle being configured for selective coupling with the rear dropouts of the bicycle;

a freewheel mechanism including a first portion engaged with the first pulley, and a second portion engaged with a cassette having a plurality of sprockets each configured to interface with a chain of the bicycle when the bicycle is coupled to the bike trainer, the freewheel mechanism further including an adapter configured to permit the second portion to engage more than one type of cassette, wherein the freewheel mechanism is operative to disengage the first portion from the second portion when the first portion rotates faster than the second portion in a forward direction;

a second pulley rotatably mounted on the first side of the frame on a laterally extending second axle;

a flexible drive member in driving engagement with and extending between the first pulley and the second pulley; and a fan rotatably mounted on the second axle on a second side of the frame opposite the first side.

14. A bike trainer for use as a training device when coupled to a conventional bicycle having its rear wheel removed, the bicycle including a frame that includes rear dropouts, the bike trainer comprising:

an axle configured for selective coupling with the rear dropouts of the bicycle;

a drive member rotatably coupled to the axle and configured to be rotatably driven by a chain of the bicycle;

a freewheel mechanism including a first portion engaged with the drive member, and a second portion engaged with a cassette having a plurality of sprockets each configured to interface with the chain of the bicycle when the bicycle is coupled to the bike trainer, the freewheel mechanism further including an adapter configured to permit the second portion to engage more than one type of cassette, wherein the freewheel mechanism is operative to disengage the first portion from the second portion when the first portion rotates faster than the second portion in a forward direction; and a fan in driving engagement with the drive member and operative to be rotatably driven by the drive member.

15. A bike trainer for use as a training device when coupled to a conventional bicycle having its rear wheel removed, the bicycle including a frame that includes rear dropouts, the bike trainer comprising:

a frame;

a first drive member rotatably mounted on a first side of the frame on a laterally extending first axle, the first axle being configured for selective coupling with the rear dropouts of the bicycle;

a freewheel mechanism including a first portion engaged with the first drive member, and a second portion engaged with a sprocket configured to interface with a chain of the bicycle when the bicycle is coupled to the bike trainer, wherein the freewheel mechanism is operative to disengage the first portion from the second portion when the first portion rotates faster than the second portion in a forward direction;

a second drive member rotatably mounted on the first side of the frame on a laterally extending second axle;

a flexible drive member in driving engagement with and extending between the first drive member and the second drive member; and a fan rotatably mounted on the second axle on a second side of the frame opposite the first side, the fan comprising a plurality of radially extending fan blades each having a proximal end and a distal end, and an outer band that extends circumferentially around distal ends of each of the plurality of fan blades, wherein the plurality of fan blades are angled such that when the fan rotates in a forward direction, air will flow from a side of the fan proximate to the frame to a side of the fan spaced apart from the frame.

16. The bike trainer of claim 15, further comprising:

a base coupled to a lower portion of the frame and operative to support the frame during use, the base comprising a center support portion, a laterally extending left support portion, and a laterally extending right support portion.

17. The bike trainer of claim 15, wherein the first axle is secured to the frame by an axle clamp and an axle clamp adjustment, such that a user may selectively couple the rear dropouts of the bicycle to the bike trainer without the use of tools.

18. The bike trainer of claim 15, wherein the first drive member and the second drive member each include teeth.

19. The bike trainer of claim 15, further comprising:

a tension pulley rotatably mounted on the frame at a position between the first drive member and the second drive member, and a tension pulley adjustment coupled to the frame and operative permit a user to selectively adjust the position of the tension pulley to selectively adjust the tension of the flexible drive member.

20. The bike trainer of claim 15, further comprising:

a fan housing enclosing the fan and including a first fan grill and a second fan grill positioned on opposing sides of the fan housing.

21. The bike trainer of claim 15, wherein the fan has a weight that is between 10 pounds and 15 pounds.

22. The bike trainer of claim 15, wherein the fan has a moment of inertia about its spinning axis of between 220 and 260 pound square inches ($lb*in^2$).

23. A method of training using a bike trainer, comprising providing a bicycle having its rear wheel removed, the bicycle including a frame that includes rear dropouts;

providing a bike trainer comprising:

a frame;

a first drive member rotatably mounted on a first side of the frame on an laterally extending first axle, the first axle being configured for selective coupling with the rear dropouts of the bicycle;

a freewheel mechanism including a first portion engaged with the first drive member, and a second portion engaged with a sprocket configured to interface with a chain of the bicycle when the bicycle is coupled to the bike trainer, wherein the freewheel mechanism is operative to disengage the first portion from the second portion when the first portion rotates faster than the second portion in a forward direction;

a second drive member rotatably mounted on the first side of the frame on a laterally extending second axle;

a flexible drive member in driving engagement with and extending between the first drive member and the second drive member; and a fan rotatably mounted on the second axle on a second side of the frame opposite the first side, the fan comprising a plurality of radially extending fan blades each having a proximal end and a distal end, and an outer band that extends circumferentially around distal ends of each of the plurality of fan blades, wherein the plurality of fan blades are angled such that when the fan rotates in a forward direction, air will flow from a side of the fan proximate to the frame to a side of the fan spaced apart from the frame;

coupling the rear dropouts of the bicycle to the first axle of the bike trainer;

positioning a chain of the bicycle entrained on the sprocket; and rotating pedals of the bicycle to cause the chain to impart a drive force on the sprocket.

24. A bike trainer for use as a training device when coupled to a conventional bicycle having its rear wheel removed, the bicycle including a frame that includes rear dropouts, the bike trainer comprising:

a frame;

a first pulley rotatably mounted on a first side of the frame on a laterally extending first axle, the first axle being configured for selective coupling with the rear dropouts of the bicycle;

a freewheel mechanism including a first portion engaged with the first pulley, and a second portion engaged with a sprocket configured to interface with a chain of the bicycle when the bicycle is coupled to the bike trainer, wherein the freewheel mechanism is operative to disengage the first portion from the second portion when the first portion rotates faster than the second portion in a forward direction;

a second pulley rotatably mounted on the first side of the frame on a laterally extending second axle;

a flexible drive member in driving engagement with and extending between the first pulley and the second pulley; and a fan rotatably mounted on the second axle on a second side of the frame opposite the first side, the fan comprising a plurality of radially extending fan blades each having a proximal end and a distal end, and an outer band that extends circumferentially around distal ends of each of the plurality of fan blades, wherein the plurality of fan blades are angled such that when the fan rotates in a forward direction, air will flow from a side of the fan proximate to the frame to a side of the fan spaced apart from the frame.

* * * * *